United States Patent [19]

Zaki et al.

[11] 4,022,938

[45] May 10, 1977

[54] FABRIC TREATMENT COMPOSITIONS

[75] Inventors: Wahib Nassif Zaki, Brussels, Belgium; Alan Pearce Murphy, Colerain Township, Hamilton County, Ohio

[73] Assignee: The Procter & Gamble Company, Cincinnati, Ohio

[22] Filed: Jan. 23, 1975

[21] Appl. No.: 543,607

Related U.S. Application Data

[63] Continuation-in-part of Ser. No. 461,312, April 16, 1974, abandoned.

[52] U.S. Cl. ..... 427/242; 252/8.6; 252/8.8; 252/8.9; 252/305; 428/262; 428/264; 428/289; 428/136

[51] Int. Cl.[2] ..... D06M 13/46; D06M 13/20

[58] Field of Search ..... 252/8.9, 8.6, 8.75, 252/8.8, 305; 427/242; 428/262, 264, 289, 136

[56] References Cited

UNITED STATES PATENTS

| | | | |
|---|---|---|---|
| 2,461,063 | 2/1949 | Elsen | 427/175 X |
| 2,735,790 | 2/1956 | Waitkus | 428/394 |
| 3,686,025 | 8/1972 | Morton | 252/8.9 X |
| 3,793,196 | 2/1974 | Okazaki et al. | 252/8.8 |

FOREIGN PATENTS OR APPLICATIONS

| | | |
|---|---|---|
| 1,313,697 | 4/1973 | United Kingdom |

*Primary Examiner*—Harris A. Pitlick
*Attorney, Agent, or Firm*—Ronald L. Hemingway; George W. Allen; Richard C. Witte

[57] ABSTRACT

Anti-static fabric softening articles and methods which utilize a composition comprising a cationic fabric softener in combination with a "sorbitan ester" as a second fabric softener and release aid. The composition is releasably affixed or incorporated into a dispensing means and applied to fabrics in an automatic laundry dryer.

22 Claims, No Drawings

FABRIC TREATMENT COMPOSITIONS

CROSS REFERENCCE TO RELATED APPLICATION

This application is a continuation-in-part of the U.S. Pat. application of Wahib N. Zaki having Ser. No. 461,312, filed Apr. 16, 1974 now abandoned.

BACKGROUND OF THE INVENTION

The present invention relates to articles and methods for imparting softening and anti-static benefits to fabrics in an automatic laundry dryer. More specifically, damp fabrics are commingled with a softening composition containing cationic fabric softener and a "sorbitan ester" component in an automatic clothes dryer to provide a soft, antistatic finish concurrently with the drying operation. The softening compositions herein are employed in combination with a dispensing means adapted for use in an automatic dryer. The sorbitan ester not only provides fabric softening but also serves to improve release of the softening composition from certain types of dryer dispensing means. Furthermore, the sorbitan ester materials herein, when employed in combination with conventional cationic fabric softening agents in a laundry dryer, provide antistatic performance superior to that obtained when either cationic materials or sorbitan ester materials along are used in the dryer.

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners desirably provide both softening and antistatic benefits when applied to fabrics. Indeed, with fabrics such as nylon and polyester, the user is more able to perceive and appreciate an anti-static benefit than a true softening benefit.

Fatty alkyl cationic anti-static softening compounds and compositions designed for application to fabrics in an automatic dryer have been the subject of recent innovations. (See, for example, Furgal, U.S. Pat. No. 3,634,947, issued Jan. 18, 1972; Morton, U.S. Pat. No. 3,686,025, issued Aug. 22, 1972 and Gaiser, U.S. Pat. No. 3,442,692, issuedMay 6, 1969.) Other fatty materials have been suggested for use as dryer-added fabric softeners (See, for example, Hewitt et al, U.S. Pat. No. 3,676,199, issued July 11, 1972 and the co-pennding application of Murphy and Habermehl, Ser. No. 417,329, filed Nov. 19, 1973). Included among these prior softening compositions are various glycerides in combination with oil-soluble, lower-ethoxylated surfactants. Triglyceride fabric treating agents are disclosed in Bernholz et al, U.S. Pat. No. 3,785,973, issued Jan. 15, 1974.

As pointed out in Hewitt et al, U.S. Pat. No. 3,676,199, issued July 11, 1972 and Wixon, U.S. Pat. No. 3,766,062, issued Oct. 16, 1973, many of the prior art softening agents stain or discolor the conditioned fabrics when used in an automatic dryer. The unfortunate tendency of such materials to stain fabrics is apparently caused by the presence of the fatty alkyl groups in the active softening compounds which causes them to be somewhat "greasy." Unevenly distributed fatty softeners can appear as blotchy, oily stains on the treated fabrics. Thus, the chemical structure which gives rise to the soft, lubricious feel associated with the prior art softeners can cause them to be potential fabric stainers.

A variety of mechanical methods have been employed in an attempt to reduce the tendency of dryer-added softeners to stain fabrics. The prior art fabric softening agents, for example, have been sorbed onto flexible articles designed to provide controlled release at dryer operating temperatures. While such articles are quite attractive from the standpoint of ease of manufacture and economics, staining can still be a problem if an improperly formulated flexible article becomes entangled in clothing. Various rigid dispensers and appliances have been designed which assertedly avoid any exceptionally high, localized concentration of softening agent being undesirably deposited on the fabrics in the form of greasy stains (See Hoeflin, U.S. Pat. No. 3,633,538, issued Jan. 11, 1972 and Grand et al, U.S. Pat. No. 3,698,095, issued Oct. 17, 1972). However, such dispensers are costly and have not come into general use.

Certain surfactants have been suggested for obviating the tendency of the prior art softeners to stain fabrics (See the co-pending application of Murphy and Habermehl, Ser. No. 440,932, filed Feb. 8, 1974). This non-staining aspect is especially important when the common polyester fabrics, which are oleophilic and particularly susceptible to oily staining, are softened in an automatic dryer. However, such surfactants are mainly anionic in nature, and are not suitable for use with the common cationic softeners.

As noted above, many softening compounds have been adapted for use in automatic dryers by fashioning articles which contain a pre-measured amount of the softener. Preferred articles comprise a flexible sheet substrate coated and/or impregnated with an optimal, pre-measured amount of a fabric softener. These articles are simply added to a dryer together with the fabrics to be dried. The heat and tumbling action of the dryer helps dispense the softener onto the fabric surfaces (See for example, Perez-Zamora, U.S. Pat. No. 3,632,396, issued Jan. 4, 1972). However, once sorbed onto the sheet substrate, some softeners tend to remain affixed thereto, rather than being dispensed onto the fabrics. Thus, the user of such articles cannot be assured that the optimal amount of softener is, in fact, deposited on the fabrics. To obviate this problem, it has been suggested to layer the softener onto the sheet together with surfactant-type release agents which insure substantially complete transfer to the fabrics; (See Perez-Zamora, U.S. Pat. No. 3,632,396, issued Jan. 4, 1972). However, the sorbitan esters do not appear to have been recognized as being useful for this purpose.

Finally, some cationic materials recognized for use as fabric softeners and anti-static agents in dilute aqueous rinse baths are not particularly useful in certain automatic dryers in that they are reported to soften and loosen certain paints used to protect the dryer drum and to corrode exposed metal surfaces of some automatic dryer drums.

As can be seen from the foregoing, there is considerable interest in providing reduced staining fabric softeners which can be conveniently applied to fabrics in an automatic clothes dryer. Moreover, the difficulty in securing controlled softener release from dispensers are well-recognized by workers in this field. Finally, there is likewise considerable interest in eliminating or minimizing dryer paint softening and corrosion caused by some dryer-added fabric treating products.

By the present invention, minor amounts of fatty esters of certain poly-ols, i.e., the so-called "sorbitan esters," are added to cationic fabric softeners to provide particularly useful dryer-added fabric softener compositions and articles. The sorbitan esters provide auxiliary softening and antistatic treatment of fabrics in addition to that provided by the cationic softeners. Moreover, the sorbitan esters provide improved release of softening compositions from carrier substrates when such substrates provide the means for dispensing the softening compositions herein into automatic dryers. Finally the particular fabric treating materials utilized in the present invention do not disadvantageously interact with dryer paint or exposed metal surfaces of dryer drums.

Various compounds containing hydroxyl groups are recognized as useful fabric treating agents in aqueous media, e.g., those listed in Speel et al, *Textile Chemicals and Auxiliaries*, 2nd Edition; Reinhold Publishing Corporation, 1957. Some ethoxylated alcohols are further known to be useful in textile lubricating compositions in combination with quaternary ammonium materials (See Cohen et al, U.S. Pat. No. 3,773,463, issued Nov. 20, 1973).

The use of various sorbitan ester compounds or derivatives as softeners, antistatic agents and auxiliary textile conditioners other than in an automatic clothes dryer is known. (See Atlas Powder Company Bulletin 9, "Industrial Emulsions with Atlas Surfactants," 1953; Crossfield, U.S. Pat. No. 3,827,114, issued Aug. 6, 1974; Karg, U.S. Pat. No. 3,652,419, issued Mar. 28, 1972; Simon et al, U.S. Pat. No. 2,665,443, issued Jan. 12, 1954 and Eisen, U.S. Pat. No. 2,461,043, issued Feb. 8, 1949.) Softening compositions for use in aqueous media comprising (among other components) a quaternary ammonium compound and a sorbitan ester are disclosed in Okazaki et al, U.S. Pat. No. 3,793,196, issued Feb. 19, 1974 and Waitkus, U.S. Pat. No. 2,735,790, issued Feb. 21, 1956.

The U.S. Pat. application of Murphy et al, Ser. No. 461,311, filed Apr. 16, 1974, now abandoned in favor of a continuation-in-part application having Ser. No. 543,606, filed Jan. 23, 1975 now abandoned discloses fabric softening articles comprising a major amount of a sorbitan ester softener and anti-corrosion agent and a minor amount of a cationic compound as a melting point modifying agent and auxiliary softener and antistat.

The above prior art references relating to sorbitan esters are, for the most part, directed to the aqueous media treatment of yarn during textile processing. Such references do not appear to recognize the particular advantages of these materials as auxiliary softeners, antistatic agents and controlled release aids for use with the common cationic (e.g., quaternary) compounds in dryer-added fabric softeners. Moreover, the references do not suggest the formulation of dryer-added fabric softening articles of the type disclosed herein comprising a dryer dispensing means, a major amount of a cationic softener, and a minor amount of a sorbitan ester. Nor do these references suggest the anti-corrosion, anti-paint softening benefits provided by the particular mixture of materials employed herein in automatic laundry dryers.

Accordingly, it is an object herein to provide superior methods and articles of manufacture adapted for imparting softness and antistatic benefits to fabrics in a clothes dryer.

It is another object herein to provide such fabric softening articles which are easily manufactured on a commercial scale.

It is another object herein to provide dryer fabric softening articles and methods which do not disadvantageously promote softening of dryer drum paint or corrosion of exposed metal dryer drum surfaces.

These and other objects are obtained herein as will be seen from the following disclosure.

SUMMARY OF THE INVENTION

The present invention encompasses an article of manufacture adapted for use in an automatic dryer comprising a) a fabric softening amount of a fabric softening composition containing a cationic softener of the type disclosed hereinafter and a minor amount of fatty alkyl sorbitan ester component, as defined hereinafter, especially the $C_{10}$–$C_{26}$ alkyl sorbitan mono- and di-esters, and b) a dryer dispensing means releasably containing an effective amount of said fabric softening composition. The dryer dispensing means provides for release of the fabric softening composition at automatic dryer operating temperatures, i.e., about 50°C–100°C, and release is preferably facilitated by the tumbling action of the damp fabrics in the dryer.

The invention also encompasses a method for imparting a softening and anti-static effect to fabrics in an automatic dryer comprising commingling pieces of damp fabric by tumbling said fabrics under heat in a clothes dryer with an effective, i.e., softening, amount of a mixture comprising a major amount of a cationic fabric softener component and a minor amount of a sorbitan ester component.

DETAILED DESCRIPTION OF THE INVENTION

The articles herein are fashioned from certain cationic fabric softeners, certain "sorbitan esters," and a dryer dispensing means, all as more fully described hereinafter.

FABRIC SOFTENING COMPOSITIONS

The fabric softening compositions employed in the present invention comprise a major amount (from about 50% to 99.9% by weight) of a conventional cationic fabric softening material and a minor amount (from about 0.1% up to 50% by weight) of a sorbitan ester component as a fabric softening agent and release aid. The weight ratio of cationic material to sorbitan ester is greater than 1:1. In addition to performing a fabric softening function, such compositions provide a synergistic antistatic effect when employed in the dryer and further and surprisingly compatible with dryer drum metal and paint.

CATIONIC SOFTENER COMPONENT

The cationic component of the fabric softening compositions herein can comprise any of the cationic (including imidazolinium) compounds listed in Morton, U.S. Pat. No. 3,686,025, issued Aug. 22, 1972, and Diery et al, U.S. Pat. No. 3,849,435, issued Nov. 19, 1974; both patents incorporated herein by reference. Such materials are well known in the art and include, for example, the quaternary ammonium salts having at least one, preferably two, $C_{10}$–$C_{22}$ fatty alkyl substituent groups; alkyl imidazolinium salts wherein at least one alkyl group contains a $C_8$–$C_{25}$ carbon "chain"; the $C_{12}$–$C_{20}$ alkyl pyridinium salts, and the quaternary materials derived from fatty amidoamines.

Preferred softeners herein include the cationic quaternary ammonium salts of the general formula $R^1R^2R^3R^4N^+X^-$, wherein groups $R^1$, $R^2$, $R^3$ and $R^4$ are, for example, alkyl and $X^-$ is an anion, e.g., halide, methylsulfate, ethylsulfate and the like. Especially preferred softeners herein are those wherein $R^1$ and $R^2$ are each $C_{12}$–$C_{22}$ fatty alkyl, $R^3$ and $R^4$ are each $C_1$–$C_3$ alkyl and $X^-$ is methyl sulfate. The fatty alkyl groups can be mixed, i.e., the mixed $C_{14}$–$C_{18}$ coconut-alkyl and mixed $C_{16}$–$C_{18}$ tallowalkyl quaternary compounds. Alkyl groups $R^3$ $R^4$ are preferably methyl. As noted, useful quaternary ammonium compounds herein are set forth in more detail in Morton, U.S. Pat. No. 3,686,025, issued Aug. 22, 1972.

Particularly useful quaternary ammonium softeners herein include ditallowalkyldimethylammmonium methylsulfate, distearyldimethylammonium methylsulfate, dipalmityldimethylammonium methylsulfate and dibehenyldimethylammonium methylsulfate.

It is to be recognized that it is essential to the operation of the articles and methods herein that the softening composition substantially melt and flow at dryer operating temperatures (ca. 50°C–100°C), thereby providing for transfer of the softening composition by contact with fabrics. While many cationic fabric softeners are solids which do not exhibit optimal flow properties at dryer operating temperatures, the sorbitan esters used herein in admixture with these cationic compounds have now been found to lower the melting point range of these materials to well within the optimal dryer operating temperature range.

It should be further recognized that the cationic softeners useful herein can contain minor amounts of free (unquaternized) amines, lower chain length materials, and the like, which arise from processing. The presence or absence of such contaminants is of no consequence in the articles or methods herein.

SORBITAN ESTER COMPONENT

The auxiliary softener/release aids employed in the present invention comprise the esterified dehydration products of sorbitol. Sorbitol, itself prepared by the catalytic hydrogenation of glucose, can be dehydrated in well known fashion to form mixtures of 1,4- and 1,5-sorbitol anhydrides (and small amounts of isosorbides) according to the following reaction: (See Brown, U.S. Pat. No. 2,322,821, issued June 29, 1943)

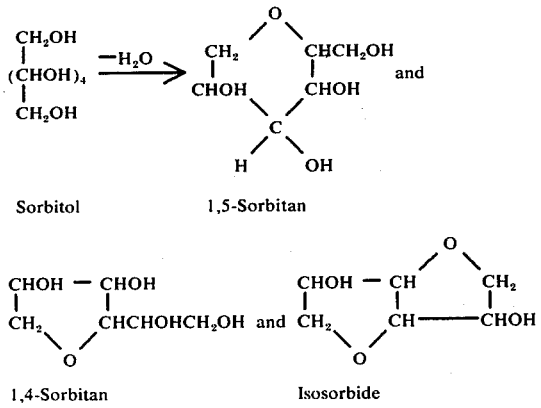

The foregoing complex mixtures of anhydrides of sorbitol are collectively referred to herein as "sorbitan". It will be recognized that this "sorbitan" mixture will also contain some free, uncyclized sorbitol.

The auxiliary softener/release aids of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can simply be adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers: Processing and Quality Control, " *Journal of the American Oil Chemists'; Society, Volume* 45, October 1968.

The sorbitan mono-esters and di-esters are preferred components of sorbitan ester mixtures which can be utilized in the softening compositions of the present invention. Sorbitan ester mixtures which predominate in mono- and di- esters appear to provide a greater degree of static control and are less likely to stain fabrics when utilized within the dryer in the context of the present invention.

The mixtures of hydroxy-substituted sorbitan esters useful herein contain, inter alia, compounds of the following formulae, as well as the corresponding hydroxy-substituted di-esters:

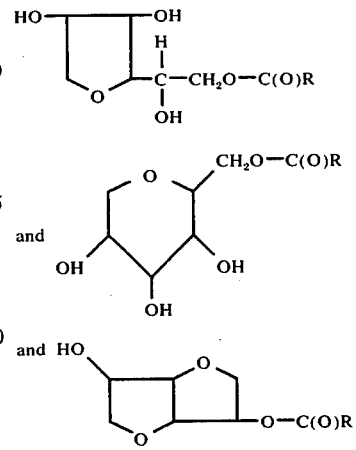

wherein the group RC(O)— is a $C_{10}$–$C_{26}$, and higher, fatty alkyl residue. Preferably this fatty alkyl residue contains from 16 to 22 carbon atoms. The fatty alkyl reside can, of course, contain non-interfering substituents such as hydroxyl groups. Esterified hydroxyl groups can, of course, be either in terminal or internal positions within the sorbitan molecule.

The foregoing complex mixtures of esterified dehydration products of sorbitol (and small amounts of esterified sorbitol) are collectively referred to herein as "sorbitan esters." Sorbitan mono- and di-esters of lauric, myristic, palmitic, stearic and behenic (docosanoic) acids are particularly useful herein as release aids and, themselves, help provide a soft, lubricious feel and anti-static benefit to fabrics. Mixed sorbitan esters, e.g., mixtures of the foregoing esters, and mixtures prepared by esterifying sorbitan with fatty acid mixtures such as the mixed tallow fatty acids, are useful herein and are economically attractive. Unsaturated $C_{10}$–$C_{22}$ sorbitan esters, e.g., sorbitan monooleate, usually are present in such mixtures in low concentration. The term "alkyl" as employed herein to describe the sorbitan esters encompasses both the saturated and unsaturated hydrocarbyl ester side chain groups.

It is to be recognized that all sorbitan esters containing free -OH groups which soften and flow at dryer operating temperatures, i.e., above 38° C, and which have fatty hydrocarbyl "tails, " are useful auxiliary softeners and release aids in the context of the present invention.

It will be further recognized that certain derivatives of the sorbitan esters herein, especially the "lower" ethoxylates thereof (i.e., mono-, di- and tri-esters wherein one or more of the unesterified -OH groups contain one to about twenty oxyethylene moieties [Tweens] are also useful in the articles and methods of the present invention. Therefore, for purposes of the present invention, the term "sorbitan ester" includes such derivatives.

Preparation of the sorbitan esters herein can be achieved by dehydrating sorbitol to form a mixture of anhydrides of the type set forth above, and subsequently esterifying the mixture using, for example, a 1:1 stoichiometry for the esterification reaction. The esterified mixture can then be separated into the various ester components. Separation of the individual ester components. Separation of the individual ester products is, however, difficult and expensive. Accordingly, it is easier and more economical not to separate the various esters, using instead the esterified mixture as the sorbitan ester component. Such mixtures of esterified reaction products are commercially available under various tradenames, e.g., Span. Such sorbitan ester mixtures can also be prepared by utilizing conventional interesterification procedures.

The preferred alkyl sorbitan esters for use in the softening compositions herein include sorbitan monolaurate, sorbitan monomyristate, sorbitan monopalmitate, sorbitan monostearate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed coconutalkyl sorbitan mono- and di-esters and mixed tallowalkyl sorbitan mono- and di-esters. Such mixtures are readily prepared by reacting the foregoing hydroxy-substituted sorbitans, particularly the 1,4- and 1,5- sorbitans, with the corresponding acid or acid chloride in a simple esterification reaction. It is to be recognized, of course, that commercial materials prepared in this manner will comprise mixtures containing minor proportions of various tri-esters, tetra-esters, uncyclized sorbitol, fatty acids, polymers, isosorbide structures, and the like. The presence or absence of such materials as minor components of the sorbitan mixtures is of no consequence to this invention. For most purposes, the commercially available sorbitan ester materials which comprise from about 20% to 60% by weight of the monoester component and from about 5% to 50% by weight of the di-ester component and which have melting points of at least about 38°C can be advantageously employed in combination with cationic fabric softeners to soften clothes in the dryer in the preferred manner of practicing this invention. Highly preferred materials include sorbitan monostearate, sorbitan distearate, sorbitan monopalmitate, sorbitan dipalmitate and mixtures of these materials having stearate/palmitate weight ratios varying between 10:1 and 1:10. Both the 1,4- and 1,5- sorbitan stearates and palmitates are useful herein. The nonionic character of the sorbitan esters makes them compatible with all cationic softeners.

It is to be recognized that the sorbitan esters employed herein can contain up to about 15% by weight of esters of the $C_{20}$–$C_{26}$, and higher, fatty acids, as well as minor amounts of $C_8$, and lower, fatty esters. The presence or absence of such contaminants is of no consequence in the articles or methods herein. The most highly preferred mixtures of sorbitan esters used in the instant articles and methods melt and flow over a range of about 38° C to about 68° C.

OPTIONAL SOFTENER COMPOSITION COMPONENTS

Various additives can also be used in combination with cationic/sorbitan ester softening compositions herein. Although not essential to the invention herein, certain fabric treating additives are particularly desirable and useful, e.g., perfumes, brightening agents, shrinkage controllers, spotting agents, and the like.

While not essential, liquids which serve as a carrier for the softening agents can also be employed as part of the softening compositions herein. Such liquids can be used, for example, to impregnate an absorbent substrate more evenly with the composition when such an absorbent substrate is employed (as discussed hereinafter) as the dryer dispensing agent for the softener compositions herein. When a liquid carrier is so used, it should preferably be inert or stable with both components of the softening composition. Moreover, the liquid carrier used in substrate impregnation should be substantially evaporated at room temperature, and the residue (i.e., the softening composition and other optional materials) should then be sufficiently hardened so as not to run or drip off the substrate, or cause the substrate to stick together when folded. Isopropyl alcohol or isopropyl alcohol/water mixtures are the preferred liquid carriers for substrate impregnation purposes. Methanol, ethanol, acetone, ethylene glycol, propylene glycol, alcohol ethoxylate nonionic surfactants and/or liquefied fluorocarbons such as dichlorodifluoroethane and dichlorodifluoromethane can also be used as carriers either for dispensing the softening composition in the dryer, for introducing the softening compositions into the dryer dispensing means or for facilitating release of the softening compositions from the dryer dispensing means.

Other additives can include anti-creasing agents, finishing agents, fumigants, lubricants, fungicides, and sizing agents. Specific examples of useful additives disclosed herein can be found in any current Year Book of the American Association of Textile Chemists and Colorists. Any additive used should be compatible with the softening agent.

The amounts of fabric treating additives, (e.g., perfume and brighteners, etc.) that are generally used in combination with the softening agents are generally small, being in the range of from 0.01% to 10% by weight of the total mixed cationic/sorbitan ester softening composition. Liquid carriers, if utilized, can of course, comprise a much larger portion of the softening composition, i.e., up to 50% or higher, especially if presence of such materials is useful in the dryer dispensing of the softening composition mixture. (In an aerosol device, for example.)

DISPENSING MEANS

The mixed cationic softener/sorbitan ester softening compositions, herein can be employed by simply adding a measured amount of said composition into the dryer. However, in a preferred embodiment, the mixed softening compositions are provided as an article of manufacture in combination with a dispensing means which effectively releases the softening compositions in an automatic clothes dryer. Such dispensing means can be designed for single usage or for multiple uses.

One such article comprises a sponge material releasably enclosing enough mixed softening composition to effectively impart fabric softness during several cycles of clothes. This multi-use article can be made by filling a hollow sponge with about 20 grams of the mixture of cationic softener and sorbitan ester. In use, the mixture melts and leaches out through the pores of the sponge to soften fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the mixed softening composition and sealed with a hardened plug of the mixture. The action and heat of the dryer opens the bag and releases the mixture to perform its softening function.

Still another article comprises an aerosol cannister containing the above-described softening compositions under pressure. The composition can be dispensed from this aerosol article onto the dryer drum in the manner more fully described in Rudy et al, U.S. Pat. No. 3,650,816, issued March 21, 1972, incorporated herein by reference.

Other devices and articles suitable for dispensing the cationic/sorbitan ester softening compositions in automatic dryers include those described in Dillarstone, U.S. Pat. No. 3,736,668, issued June 5, 1973; Compa et al, U.S. Pat. No. 3,701,202, issued Oct. 31, 1972; Furgal, U.S. Pat. No. 3,634,947, issued Jan. 18, 1972; Hoeflin, U.S. Pat. No. 3,633,538, issued Jan. 11, 1972 and Rumsey, U.S. Pat. No. 3,435,537, issued April 1, 1969. All of these patents are incorporated herein by reference.

A highly preferred article herein comprises the softening compositions containing the mixture of cationic softener and sorbitan ester releasably affixed to a sheet of paper or woven or non-woven cloth substrate. When such an article is placed in an automatic laundry dryer, the heat and tumbling action of the dryer removes the softening mixture from the substrate and deposits it on the fabrics.

The sheet conformation has several advantages. For example, effective amounts of the mixed softening compositions for use in conventional dryers can be easily sorbed onto and into the sheet substrate by a simple dipping or padding process. Thus, the user need not measure the amount of softening mixture necessary to obtain fabric softness. Additionally, the flat configuration of the sheet provides a large surface area which results in efficient release of the softener materials onto fabrics by the tumbling action of the dryer.

The water-insoluble paper, or woven or non-woven substrates used in the articles herein can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

Highly preferred paper, woven or non-woven "absorbent" substrates useful herein are fully disclosed in Morton, U.S. Pat. No. 3,686,025, issued Aug. 22, 1972, cited above. It is known that most substances are able to absorb a liquid substance to some degree; however, the term "absorbent, " as used herein, is intended to mean a substrate with an absorbent capacity (i.e., a parameter representing a substrate's ability to take up and retain a liquid) from 4 to 12, preferably 5 to 7, times it weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges. Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4; commercially available household one-ply toweling paper has a value of 5 to 6; and commercially available two-ply household toweling paper has a value of 7 to about 9.5.

Using a substrate with an absorbent capacity of less than 4 tends to cause too rapid release of the softening agents from the substrate resulting in several disadvantages, one of which is uneven softening of the fabrics. Using a substrate with an absorbent capacity over 12 is undesirable, inasmuch as too little of the softening agent mixture is released to soften the fabrics in optimal fashion during a normal drying cycle.

The use of dense, one-ply or ordinary kraft or bond paper for the softening article substrate can result in increased staining of certain types of treated fabrics. This staining is caused by the low absorbent capacity of the paper substrate.

The softening agent mixture on dense paper can be rapidly and unevenly released in excessive quantities when subjected to customary dryer temperatures, with the result that treated fabrics can become stained at points of contact with the softener-coated paper. Fabric staining can be minimized by employing a substrate having an absorbent capacity in the range of 4 to 12, such that less of the softening agent mixture is released at any given point of time when contacted with the fabric being treated.

As noted above, suitable materials which can be used as a substrate in the invention herein include, among others, sponges, paper, and woven and non-woven cloth, all having the necessary absorbency requirements defined above. The preferred substrates of the softening compositions herein are cellulosic, particularly multi-ply paper and non-woven cloth.

More specifically, a preferred paper substrate comprises a compressible, laminated, calendered, multi-ply, absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds per 3,000 square feet, and the paper structure can consist of plies having the same or different basis weights. Each ply is preferably made from a creped, or otherwise extensible, paper with a creped percentage of about 15% to 40% and a machine direction (MD) tensile and cross-machine (CD) tensile of from about 100 to 1,500 grams per square inch of paper width. The two outer plies of a 3-ply paper structure of each ply of a 2-ply paper structure are embossed with identical repeating patterns consisting of about 16 to 200 discrete protuberances per square inch, raised to a height of from about 0.010 inch to 0.40 inch above the surface of the unembossed paper sheet. From about 10% to 60% of the paper sheet surface is raised. The distal ends (i.e., the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130.

Suitable adhesives for multi-ply paper are known in the art and include water, starches, wet-strength resins, and polyvinyl acetates. A particularly suitable adhesive is prepared by heating from about 2 to about 4 parts by weight of substantially completely hydrolyzed polyvinyl alcohol resin in from about 96 to about 98 parts by weight of water. Preferably, about 0.03 pound of adhesive solids are used to join 3,000 square feet of the embossed plies, with the adhesive being applied to the distal surfaces of the protuberances of one or all plies.

The compressive modulus values which define the compressive deformation characteristics of a paper structure compressively loaded on its opposing surfaces, the HOM values which refer to the stiffness or handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of its preparation, can be found in Wells; U.S. Pat. No. 3,414,459, issued Dec. 3, 1968, the disclosures of which are incorporated herein by reference.

The preferred non-woven cloth substrates used in the invention herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, polyolefins, polyamides, or polyesters).

Methods of making non-woven cloths are not a part of this invention and, being well known in the art, are not described in detail herein. Generally, however, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the non-woven cloth. Non-woven cloths made of polyesters, polyamides, vinyl resins, and other thermoplastic fibers can be span-bonded, i.e., the fibers are spun out onto a flat surface and bonded (melted) together by heat or by chemical reactions.

The absorbent properties preferred herein are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a softening composition by means of intersectional or capillary action. Thus, any thickness necessary to obtain the required absorbent capacity can be used.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin, or a mixture thereof, in the fiber bonding step. Moreover, the hydrophobic binder-resin, when used singly or as the predominant compound of a hydrophobic-hydrophilic mixture, provides non-woven cloths which are especially useful as substrates when the softening articles herein are used with damp fabrics in an automatic dryer.

When the substrate for the softening articles herein is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 3/16 inch to 2 inches in length and are from 1.5 to 5 denier. Preferably, the fibers are at least partially oriented haphazardly, particularly substantially haphazardly, and are adhesively bonded together with a hydrophobic or substantially hydrophobic binder-resin, particularly with a nonionic self-crosslinking acrylic polymer or polymers. Preferably, the cloth comprises about 70% fiber and 30% binder-resin polymer by weight and has a basis weight of from about 18 to 24 grams per square yard.

The preferred fabric softening articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 5 to 50 volume changes of drying air in the dryer drum per minute and the air moves at about 125 to 175 cubic feet per minute. These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient number of tumbling items will normally be present to prevent any item from being drawn to the exhaust outlet or to cause it to be removed from the outlet. In the event, however, a fabric softening article is caused to be disposed in relation to the air exhaust outlet in such a manner as to cause blockage of passing air, undesirable temperature increases can result. In the case of fabric softening articles, the softening compositions substantially melt under conditions of heat, and the article may tend to adhere to an exhaust outlet.

The problem of blockage can be solved by providing openings in the article in the manner described in two U.S. patent applications of A. R. McQueary, one have Ser. No. 347,605, filed Apr. 3, 1973 now U.S. Pat. No. 3,944,694, issued Mar. 16, 1976, and the other having Ser. No. 347,606, filed Apr. 3, 1973 U.S. Pat. No. 3,956,556, issued May 11, 1976, both incorporated herein by reference, and both co-pending herewith. More specifically, slits or holes are cut through the substrate to allow free passage of air.

The slit openings are provided in the preferred fabric softening articles of the invention for two principal purposes. Importantly, the slits permit passage of air in the event the article is placed in a blocking relationship to the air exhaust outlet. Moreover, the slit openings provide a degree of flexibility or resiliency which causes the article to crumple or pucker. The effect of such crumpling is that only a portion of the air exhaust outlet will be covered by the softening article in the event it is carried by the moving air stream to the exhaust outlet. Moreover, the crumpled article is more readily removed by tumbling fabrics than would be the case if the article were placed in a flat relationship to the exhaust outlet.

The type and number of slit openings can vary considerably and will depend upon the nature of the substrate material, its inherent flexibility or rigidity, the nature of the softening agent mixture carried therein or thereon, and the extent to which increased passage of air therethrough is desired. The preferred articles of this invention can comprise a large number of small slits of various types or configurations, of fewer larger slits. For example, a single rectilinear or wavy slit, or a plurality thereof, confined to within the area of a sheet and extending close to opposite edges of the article, can be employed. By maintaining a border around all edges of the softening article, a desired degree of flexiblility and surface area availability to tumbling fabrics can be maintained. While, for example, rectilinear slits can be cut into a softening article completely to the edges of the article, confinement of the slits to within the area of the article will be preferred where the convenience of packaging the softening article in roll form is desired.

According to one preferred embodiment of the invention, a sheet of fabric-softening article is provided with a plurality of rectilinear slits extending in one direction, e.g., the machine direction of the web substrate, and in a substantially parallel relationship. The slits can be aligned or in a staggered relationship. A preferred embodiment will contain from 5 to 9 of such slits which will extend to within about 2 inches and preferably 1 inch from the edge of the web material which is, for example, a 9 inches × 11 inch sheet. In general, the greater the number and the longer the slits, the greater the effect in preventing restriction of air flow. Such an article permits the individual panel areas or sections within the rectilinear slits to flex or move in independent relationship to each other and out of the plane of the sheet. This flexing minimizes the probability that such an article will align itself in a flat and blocking relationship to an exhaust outlet. The inherent puckering or crumpling tendency of the article allows the article to contact the air outlet in such a manner as to leave at least a portion of the air exhaust outlet uncovered. In addition, the tumbling fabrics in the dryer will collide with the crumpled article causing it to be removed from the exhaust outlet. Removal is readily accomplished by reason of the protrusion of the crumpled article which makes it more available for contact with the tumbling load of fabrics in the dryer.

The slit openings in the softening articles of the invention can be in a variety of configurations and sizes, as can be readily appreciated. In some instances, it may be desirable to provide slit openings as C-, U- or V-shaped slits. Such slits arranged in a continuous or regular or irregular pattern are desirable from the standpoint of permitting gate-like or flap structures which permit the passage of air therethrough.

In accordance with a preferred embodiment of the invention, a plurality of curvilinear slit openings, such as U-shaped, or C-shaped slits are provided in a continuously patterned arrangement. These slit arrangements provide flat-like or gate-like structures which should approximate the size of the perforations normally employed in laundry dryer exhaust outlets. A width dimension of from about 0.02 to about 0.04 inch is preferred. U- or C-shaped slits, e.g., about ⅛ inch in diameter, are desirably provided in close proximity to each other, e.g., about ⅛ inch apart, as to simulate, for example, a fish-scale pattern. Such design, in addition to permitting passage of air, provides a degree of flexibility to the substrate and allows flexing or puckering of the article in use. Similarly, the slit openings can be arranged as spaced rows of slits or as a plurality of geometrical patterns. For example, a sheeted article of this invention can comprise a plurality of squares, circles, triangles or the like, each of which is comprised of a plurality of individual slits. Other embodiments include small or large S-shaped slits, X-slits or crosses, slits conforming to alphabetical or numerical patterns, logograms, marks, floral and other designs can also be employed.

As an alternative to slits, the article can be provided with one or more openings having a diameter of from about 0.02 inches to about 4 inches, from about 5% to about 40% of the surface area of the article comprising said openings. The openings can be disposed in any convenient relationship to one another but it is simplest, from a manufacturing standpoint, to punch the openings through the substrate in evenly spaced rows.

ARTICLE MANUFACTURE

The articles herein are fashioned from a dryer dispensing means and from softening compositions comprising a major amount, i.e., 50% to 99.9%, preferably from about 65% to 92% by weight, of the cationic softener, and a minor amount, i.e., 0.1% up to 50%, preferably from about 8% to 35%, by weight, of the sorbitan ester. The weight ratio of cationic softener to sorbitan ester in such compositions is greater than 1:1. Such softening compositions, as noted, can be employed in combination with a wide variety of dispensing means in order to realize the instant fabric softening articles.

Highly preferred articles herein are those wherein the softening composition is impregnated into an absorbent substrate. The impregnation can be accomplished in any convenient manner, and many methods are known in the art. For example, the composition, in liquid form, can be sprayed onto a substrate or can be added to a wood-pulp slurry from which the substrate is manufactured.

Impregnating, rather than coating, the substrate with the softening composition is highly preferred for optimal softening with minimal fabric staining. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when the softening composition is applied to an absorbent substrate it penetrates into the free space; hence, the substrate is deemed impregnated. The free space in a substrate of low absorbency, such as a one-ply kraft or bond paper, is very limited; such a substrate is, therefore, termed "dense." Thus, while a small portion of the softening composition penetrates into the limited free space available in a dense substrate, a rather substantial balance of the composition does not penetrate and remains on the surface of the substrate so that it is deemed a coating. The difference between coating and impregnation is believed to explain why the impregnated sheet substrates of the invention herein eliminate or substantially reduce the staining of fabrics observed when a coated dense substrate is utilized.

In one preferred method of making the preferred softening composition-impregnated absorbent sheet substrate, the mixed softening composition (alone or with the optional additives) is applied to absorbent paper or non-woven cloth by a method generally known as padding. The softening composition is preferably applied in liquid from to the substrate. Thus, the softening compositions which are normally solid at room temperature should first be melted and/or solvent treated with one of the liquid carriers mentioned hereinbefore. Methods of melting the softening compositions and/or for treating them with a solvent are known and can easily be done to provide a satisfactory impregnated substrate.

In another preferred method, the softening composition in liquified form is placed in a pan or trough which can be heated to maintain the composition in liquid form. The liquid composition contains any of the desired optional additives. A roll of absorbent paper (or cloth) is then set up on an apparatus so that it can unroll freely. As the paper or cloth unrolls, it travels downwardly and, submersed, passes through the pan or trough containing the liquid composition at a slow enough speed to allow sufficient impregnation. The absorbent paper or cloth then travels upwardly and through a pair of rollers which remove excess bath liquid and provide the absorbent paper with about 1 to about 12 grams of the softening agent per 100 in.$^2$ to 150 in.$^2$ of substrate sheet. The impregnated paper or cloth is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the opening between their respective surfaces can be regulated to control the amount of the softener composition liquid on the paper or cloth.

In another method of impregnation, the softener composition, in liquid form, is sprayed onto absorbent paper or cloth as it unrolls and the excess material is then squeezed off by the use of squeeze rollers or by a doctor-knife. Other variations include the use of metal "nip" rollers on the leading or entering surfaces of the sheets onto which the softening composition is sprayed; this variation allows the absorbent paper or cloth to be treated, usually on one side only; just prior to passing between the rollers whereby excess material is squeezed off. This variation can optionally involve the use of metal rollers which can be heated to maintain the softening composition herein in the liquid phase. A further method involves separately treating a desired number of the individual plies of a multi-ply paper and subsequently adhesively joining the plies with a known adhesive-joinder compound; this provides an article which can be untreated on one of its sides, yet contains several other plies, each of which is treated on both sides.

In applying the softening composition to the absorbent substrate, the amount impregnated into and/or coated onto the absorbent substrate is conveniently in the weight ratio range of from about 10:1 to 0.5:1 based on the ratio of total softening composition to dry, untreated substrate (fiber plus binder). Preferably, the amount of the softening composition ranges from about 5:1 to about 1:1:1, most preferably from about 3:1 to 1:1, by weight of the dry, untreated substrate.

Following application of the liquified softening composition, the articles are held at room temperature until the softening composition substially solidifies. The resulting dry articles, prepared at the composition:substrate ratios set forth above, remain flexible; the sheet articles are suitable for packaging in rolls. The sheet articles can optionally be slitted or punched to provide a non-blocking aspect at any convenient time during the manufacturing process.

The most highly preferred articles herein are those where a softening composition of the type disclosed above is releasably affixed to a sheet substrate of the type disclosed hereinabove having an absorbent capacity of from about 4 to about 12. A highly preferred substrate for such an article has an absorbent capacity from about 5 to 7. The most highly preferred substrate for the articles comprises a water-laid or air-laid non-woven cloth consisting essentially of cellulosic (including rayon) fibers, said fibers having a length of about 3/17 inch to about 2 inches and a denier from about 1.5 to about 5, said fibers being at least partially oriented haphazardly, and adhesively bonded together with a binder-resin. Such water-laid or air-laid non-woven cloths can easily be prepared having the preferred absorbent capacities set forth above.

The most highly preferred articles herein are those wherein the flexible substrate is provided with openings sufficient in size and number to reduce restriction by said article of the flow of air through the automatic dryer. Articles wherein the openings comprise a plurality of rectilinear slits extending along one dimension of the substrate, especially those wherein the slits extend to within 1 inch from at least one edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a non-blocking sheet substrate having the physical parameters noted hereinabove, said substrate having an area of from about 50 in.$^2$ to about 200 in.$^2$, containing from about 1.5 grams to about 7.5 grams of a softening composition, especially one comprising from about 65% to about 92% by weight of a quaternary ammonium softener of the type disclosed hereinabove and from about 8% to about 35% by weight of the above-described sorbitan esters. Highly preferred softening compositions for use in the articles herein consist of from about 65% to about 75% by weight of a quaternary ammonium methylsulfate, especially ditallowalkyldimethylammonium methylsulfate, and 25% to 35% by weight of the sorbitan esters. Such articles can be provided with, as an additional component, from about 0.01% to about 10% by weight of the fabric softening composition of optional fabric treating additives of the type disclosed hereinabove. The articles are provided with openings such as the holes or slits described hereinabove, said openings comprising from about 0.5% to about 75%, preferably 5% to about 40%, of the area of the article, said openings being so disposed as to provide a non-blocking effect.

It should be noted that the preferred absorbent substrate articles described above are surprisingly easy to manufacture on a commercial scale. Production of these substrates with the particular two component softening compositions of the instant invention generally results in a significantly lower level of softener composition dusting and buildup on machinery in comparison to dusting and buildup resulting from the manufacture of similar prior art products utilizing quaternary materials alone.

USAGE

In the method aspect of this invention the mixed fabric softening compositions are used in an effective amount to soften and condition fabrics in an automatic dryer. The effective, i.e., softening and static-controlling, amount of the compositions used in the manner of this invention will depend somewhat on the type of fabric being treated and the dampness of the surrounding atmosphere. For example, it is well-known that under conditions of low humidity, static control in fabrics is somewhat more difficult to achieve than under conditions of high humidity.

For most purposes, the compositions herein are applied to fabrics at a rate of about 0.01 gram to about 12.0 grams, preferably 1 g. to about 3 g., per 5 lbs. of fabrics on a dry fabric weight basis. Higher usage rates can be employed, if desired, but can result in an undesirable greasy feel on the fabrics.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The softening compositions herein are simply spread in a fairly uniform manner over all fabric surfaces, for example, by sprinkling them onto the fabrics from a shaker device. Alternatively, the compositions can be sprayed or otherwise coated on the dryer drum, itself. The dryer is then operated in standard fashion to dry the fabrics, usually at a temperature from about 50° C to about 80° C for a period of from about 10 minutes to about 60 minutes, depending on the fabric load and type. On removal from the dryer, the dried fabrics are softened and coated with the composition which quickly and effectively dissipates static charge.

In a preferred mode, the present process is carried out by fashioning an article comprising the substrate dispensing means of the type hereinabove described in releasable combination with the softening composition. This article is simply added to a clothes dryer together with the damp fabrics to be treated. The heat and tumbling action of the revolving dryer drum evenly distributes the composition over all fabric surfaces, and dries the fabrics.

The following are examples of the articles and methods of this invention, but are not to be considered limiting thereof.

EXAMPLE I

A dryer-added fabric softening article is prepared by sprinkling 5.0 grams of a softening composition comprising 4.0 grams of mixed tallowalkyldimethylammonium methylsulfate and 1.0 gram of SPAN 60 (ICI America's commercial mixture of sorbitan "stearate" comprising a total of about 90% by weight total sorbitan and isosorbide esters, and approximately equal amounts of free fatty acids, free sorbitol, free sorbitan, minor proportions of isosorbide, about 31% by weight of the mixture comprising mono-esters of sorbitans, including isosorbide) uniformly over the surface of an air-laid non-woven cloth comprising 70% regenerated cellulose (American Viscose Corporation) and 30% hydrophobic binder-resin (Rhoplex HA-8 on one side of the cloth, and Rhoplex HA-16 on the other side; Rohm & Haas Co.). The cloth has a thickness of 4 to 5 mils, a basis weight of about 24 grams per square yard and an absorbent capacity of 6. A one foot length of the cloth, 8⅓ inches wide, weighs about 1.78 grams. The fibers in the cloth are ca. ¼ inch in length, 1.5 denier, and are oriented substantially haphazardly. The fibers in the cloth are lubricated with sodium oleate. The substrate cloth is 10 inch × 11 inch. The coated cloth is transferred to a heated plate, whereupon the composition melts and impregnates the inter-fiber free space in the cloth substrate. The article is removed from the hot plate and allowed to cool to room temperature, whereby the softening composition solidifies. The cloth retains its flexibility.

Following solidification of the softening composition, the cloth is slitted with a knife. (Conveniently, the cloth is provided with 5 to 9 rectilinear slits extending along one dimension of the substrate, said slits being in a substantially parallel relationship and extending to within about 1 inch from at least one edge of said dimension of the substrate.) The width of an individual slit is ca. 0.2 inches.

An article prepared in the foregoing manner is placed in an automatic clothes dryer together with 5 lbs. of freshly washed, damp (ca. 5.5 lbs. water) mixed cotton, polyester, and polyester/cotton blend clothes. The automatic dryer is operated at an average temperature of 60° C for a period of 45 minutes. During the course of the drying operation the clothes and softener article are constantly tumbled together by the rotation of the dryer drum. After the drying cycle, the clothes are removed from the dryer into a room having a relative humidity of 50%. The clothes are found to exhibit excellent softness and anti-static properties.

A similar article is prepared from the ditallowalkyl quaternary softener but without added sorbitan ester. After use in a dryer, only about one-third of the softener is found to have been transferred from the article to the fabrics.

EXAMPLE II

A dryer-added fabric softening article is prepared in the following manner. A softening composition comprising 75% by weight of ditallowalkyldimethylammonium methylsulfate and 25% by weight of SPAN 60 is placed in a trough and heated until melted.

A 10 inch wide roll of paper substrate is utilized, said substrate being a compressible, laminated and calendered absorbent paper structure comprising two extensible paper sheets, each sheet (or ply) having a basis weight of about 16 lbs. per 3000 square feet and a MD value of about 660, a CD value of about 380 and 20% dry-crepe. Each sheet of the paper substrate is embossed with identical raised patterns consisting of about 70 inwardly directed discrete protuberences per square inch, raised about 0.02 inches above the surface of the paper sheets. The protuberences constitute about 45% of the surface of each sheet and are mated and adhesively joined with polyvinyl alcohol resin. The paper structure exhibits a compressive modulus of about 340 together with HOM MD/CD values of about 36/31 and has an absorbent capacity of about 7. (This paper is a particularly preferred paper substrate herein and weighs about 3.7 grams per 10 inch × 12 inch sheet).

The paper sheet substrate is mounted on a roll and is unrolled in the trough. The paper travels at a rate of 5–6 feet per minute and is then directed upwardly and through the pair of hard, rubber follers mounted so that their surfaces just touch. The turning rollers squeeze off excess softening composition and impregnate the paper with the composition at a composition: paper impregnation ratio of about 2.7:1 by weight of the dry, untreated paper. After passing through the rollers, the liquified composition (now impregnated into the paper) is cooled and hardened. The resulting paper article is substantially solid, yet flexible, is stable to decomposition, not "runny" or dripping, and which, although waxy to the touch, does not stick together when folded.

An 10 in. × 12 in. paper-impregnated article prepared in the foregoing manner is punched with 9 evenly-spaced 0.5 in. diameter holes. The resulting article contains about 8 grams of the softening composition. The article is placed in an automatic clothes dryer together with 5 lbs. of mixed clothes which are dampened with an equal amount of water. The dryer is operated at an average temperature of 56° C for a period of 40 minutes, with tumbling. At the end of the drying cycle, the clothing is removed from the dryer and is found to be provided with an excellent soft and anti-static finish. The dryer operates without any vent blockage.

In the foregoing article the SPAN 60 is replaced by an equivalent amount of SPAN 40 (the corresponding complex mixture of sorbitan palmitates marketed by ICI America) and equivalent performance results are secured.

EXAMPLE III

A controlled-release dryer-added softener article is as follows. 0.5 Grams of DURTAN 60 (Durkee Industrial Foods Group/SCM Corp.; comprising greater than 30% by weight stearic and palmitic acid esters of sorbitan, free stearic acid, free palmitic acid, free sorbitol, free sorbitan and minor amounts of isosorbide) are added to 25 mls. of isopropyl alcohol. 10.0 Grams of ditallowalkyldimethylammonium methylsulfate, 0.1 gram of mixed coconut alcohol ethoxylates having an average degree of ethoxylation of 6, and 0.01 grams of perfume are added to the mixture. The mixture is stirred and warmed to about 35° C to provide a free flowing slurry of the fabric treating components.

The substrate used is a 11 in. × 12 in. water-laid, non-woven cloth commercially available from the C. H. Dexter, Division of Dexter Corp., comprising fibers of regenerated cellulose, about ⅜ in. in length, about 1.5 denier, and lubricated with a standard textile lubricant. The fibers comprise about 70% of the non-woven cloth by weight and are oriented substantially haphazardly; a binder-resin (HA - 8) comprises about 30% by weight of the cloth. The cloth is about 4 mils thick, has a basis weight of about 24 grams per square yard and an absorbent capacity of 5.7. One foot length of the cloth, 8⅓ inches wide, weighs about 1.66 grams.

The substrate cloth is placed in a shallow trough and is sprayed uniformly with the above-described isopropyl alcohol mixture. Four separate sprayings are used, i.e., each spraying uses ca. ¼ of the above-described mixture. The isopropyl alcohol is allowed to evaporate from the substrate after each spraying. After the final spraying, the article is allowed to dry at room temperature, overnight. The final article is substantially free from isopropyl alcohol, is flexible, and contains the fabric treating components uniformly impregnated in the substrate free space.

The article prepared in the foregoing manner is placed in an automatic dryer together with 5.5 lbs. of damp (3 lbs. water) clothes and the dryer is operated with tumbling at an average temperature of 65° C for a period of 35 minutes. On removal from the dryer, the clothes are found to be provided with a uniform soft and anti-static finish. The clothes are also left with a pleasant perfume odor.

In the foregoing procedure, the isopropyl alcohol is replaced by an equivalent amount of ethyl alcohol (95%) and equivalent performance results are secured.

In the foregoing article the ditallowalkyldimethylammonium methylsulfate is replaced by an equivalent amount of dipalmityldimethylammonium methylsulfate, distearyldimethylammonium methylsulfate, and dibehenyldimethylammonium methylsulfate, respectively, and equivalent performance results are secured.

EXAMPLE IV

An article which can be used to provide thru-the-dryer fabric softening is prepared in aerosol form. 25 Grams of a mixture comprising 20 grams of di-(hydrogenated tallowalkyl)dimethylammonium dimethylammonium methylsulfate and 5 grams of GLYCOMUL P (Glyco Chemicals' mixture of palmitic acid esters of sorbitan) are admixed with 50 mls. of isopropyl alcohol until a homogeneous mixture is secured. The mixture is placed in a suitable aerosol container to which is added 15 mls. of a 1:1 (wt.) mixture of liquified dichlorodifluoroethane and dichlorodifluoromethane propellant gas. Following the pressure fill, the aerosol can is provided with a standard actuator valve and dip tube extending to the bottom of the can.

A standard laundry dryer drum, at ambient temperature, is sprayed uniformly with 10 grams of the foregoing aerosol composition. 5 Pounds of damp clothing containing about 5 lbs. of water are added to the dryer drum, and the dryer is operated in standard fashion at a temperature averaging around 57° C for a period of 35 minutes. After the drying cycle is over, the clothes are allowed to come to ambient temperature and are removed from the dryer. The clothes are found to be provided with a soft, anti-static finish.

EXAMPLE V

A fabric softening article in a sheet configuration is prepared in the following manner. The mode of preparation illustrates the advantages of the sheet configuration for the article, inasmuch as a high speed line can be employed in its manufacture. Moreover, the article can conveniently be packaged in roll form, with individual sheets having a pre-measured amount of fabric softener being circumscribed by perforations at regular intervals on the roll.

Sorbitol and mixed hydrogenated tallow fatty acids are admixed at a 1:1 molor ratio of sorbitol: total fatty acids. The hydrogenated tallow fatty acids employed comprise greater than 90% by weight of $C_{10}$–$C_{18}$ saturated and unsaturated acids, with a high percentage of the acids lying in the $C_{16}$–$C_{18}$ range. 0.1 Mole of boron trifluoride (as $BF_3 \cdot Et_2O$) is added to the reaction mixture, which is then refluxed with heat until approximately 2 moles of water are removed. The resulting reaction mixture is held at reflux for an additional hour, and is then neutralized with 0.1 molar sodium hydroxide solution. The reaction product is washed twice with 1 liter portions of water. The mixed sorbitan ester reaction products are salted out of the mixture with brine and are dissolved in isopropyl alcohol. The isopropyl alcohol solution is dried with molecular sieves, and the substantially anhydrous sorbitan esters are recovered by filtration and evaporation of the solvent.

The mixed tallowalkyl sorbitan esters prepared in the foregoing manner are placed in a flat, shallow trough together with ditallowalkyldimethylammonium methylsulfate, at a weight ratio of sorbitan esters to the ammonium salt of 25:75, and the mixture is liquefied by warming. A non-woven cloth substrate of the type disclosed hereinabove in Example I, 11 inches in width, is passed through the liquefied mixture at a rate of 500 linear feet per minute. The substrate sheet coated with the liquefied mixture is passed through a series of rollers adjusted to exert about 5 lbs. per square inch pressure on the substrate sheet. The resulting sheet contains about 6 grams – 7 grams of the mixture per 120 in.$^2$, said mixture being impregnated in the free space of the substrate. The substrate is then passed through an array of 9 knives disposed to provide rectilinear slits extending along the machine axis. Slits having an average width of 0.4 inches are thereby provided. The substrate is perforated at 12 inch intervals and the knives are disposed to slit the substrate to within 1 inch of the perforations. The resulting article is non-tacky, non-blocking and is conveniently packaged in roll form.

In use, an article prepared in the foregoing manner is torn from the roll at a perforation and is placed together with damp fabrics in an automatic dryer in the manner disclosed hereinabove. The dryer is operated in standard fashion, with tumbling, and a significant amount of the softening composition is removed from the substrate sheet and is uniformly deposited on the fabric surfaces to provide a soft, anti-static finish.

In the foregoing article, the mixed tallowalkyl sorbitan esters are replaced with an equivalent amount of mixed coconutalkyl sorbitan esters, 1,4-sorbitan monostearate, 1,4-sorbitan monopalmitate, 1,4-sorbitan distearate, 1,4-sorbitan dipalmitate and mixtures of the foregoing 1,4-sorbitan esters with their 1,5-sorbitan ester analogs, respectively, and equivalent performance results are secured.

The foregoing article is modified by adding 0.2 grams of any of the following adjunct materials to each article: bis-(styrylsulfonate)biphenyl (dryer-compatible optical brightener); and p-chlorophenol (biocide). The resulting articles distribute the adjunct materials evenly over fabrics by virtue of the tumbling action of an automatic dryer to provide their indicated benefits.

EXAMPLE VI

A fabric softening article in sheet configuration is prepared by impregnating a flexible non-woven substrate with a liquid fabric softening composition.

The flexible substrate utilized is non-woven and made of rayon fiber (~70%) and polyvinyl acetate binder (~30%). Fiber utilized is approximately 1 and 9/16 inches in length and denier of 3. The substrate has an absorbent capacity of about 6.5 and is provided in a roll containing detachable sheets which are 9 inches by 11 inches in size.

The flexible substrate is impregnated with a mixture of softening agents of the cationic and nonionic type. The cationic component of the softening agent mixture is di(tallowalkyl) dimethylammonium methylsulfate obtained as a commercial product from Ashland Chemical Company. The nonionic component of the softening agent mixture comprises the $C_{16}$ and $C_{18}$ alkyl mono, di, tri, and tetra esters of sorbitan, isosorbide and small amounts of sorbitol (collectively "sorbitan esters") and is obtained as a commercial product from Mazer Chemical, Inc. This sorbitan ester mixture contains from about 52% to 59% by weight of the $C_{16}$ material and from about 41% to 48% by weight of the $C_{18}$ material. The sorbitan ester mixture further comprises from about 29% to 33% by weight of the monoester component, from about 31% to 28% by weight of the diester component and from about 23% to 32% by weight of the tri and tetra ester component. The total softening agent mixture contains approximately 67% by weight of the quaternary ammonium compound, approximately 30% by weight of the sorbitan ester materials, and approximately 3% optional materials. The article having this proportion of cationic and nonionic softening agents is hereinafter referred to as the "Example VI (70%/30%)" article.

The softening agent mixture as described above is liquefied by heating and is then coated onto one side of the flexible substrate being fed from a roll in a high speed line operation. The coated side of the substrate is contacted with a rotating cylindrical member which serves to press the liquefied softening agent mixture into the interstices of the substrate. The substrate is passed over several chilled tensioning rolls which help solidfy the softening agent mixture impregnated into the substrate sheet. The substrate sheet is 9 inches wide and is perforated in lines at 11 inch intervals to provide detachable sheets. Each sheet is cut with a set of knives to provide six parallel slits in the sheet 1 and 3/16 inches apart. Such slits average in length from 5 to 7 inches.

The impregnated substrate has a total impregnate to substrate weight ratio which averages about 2.0:1. The substrate sheets contain an average of about 3.1 grams of impregnate per sheet. (From about 2 to 2.4 grams per sheet of the quaternary ammonium material and from about 0.9 to 1.0 gram per sheet of the sorbitan ester material).

Such a fabric softening article can be utilized in the laundry dryer to provide fabric softening and anti-static benefits.

A substantially similar fabric softening article is prepared with a slight variation in the softening agent mixture. In this second article, the softening agent mixture contains about 88.2% by weight of the quaternary ammonium compound, about 9.6% by weight of the sorbitan ester materials and about 2.2% by weight optional materials. This second article having this proportion of cationic and nonionic softening agents is hereinafter referred to as the "Example VI (90%/10%)" article.

For the Example VI (90%/10%) article the sorbitan ester mixture contains about 59% by weight of the $C_{16}$ material and about 41% by weight of the $C_{18}$ material. The sorbitan ester mixture further comprises about 32% by weight of the monoester component, about 37% by weight of the diester component and about 23% by weight of the tri and tetraester component.

The Example VI (90%/10%) article has a total impregnate/substrate weight ratio which averages about 2.4:1. Sheets of this article contain an average of about 3.6 grams of impregnate per sheet (about 3.2 grams per sheet of the quaternary ammonium material and about 0.35 gram per sheet of the sorbitan ester material).

This (90%/10%) article, like the (70%/30%) article can be utilized in the laundry dryer to provide fabric softening and anti-static benefits.

FABRIC SOFTENING AND STATIC EVALUATION

The fabric softening and anti-static performance of certain of the articles of the instant invention is determined by means of a softening and static charge evaluation. In such an evaluation, 5¼ lb. loads of fabrics representing a range of fabric types (cotton, polyester-cotton, polyester, acrylics, and nylon) are washed, using a leading detergent, a ten-minute wash cycle with hot (125° F) medium hardness (8–10 grain/gallon) water, a two minute rinse in warm (100° F) water, and are dried for 45 minutes in standard household clothes dryers. Included in each 5¼ pound fabric load are four 100% cotton terrycloths to be used for softness grading. (All these terries are pre-treated in the following manner to remove any "factory finishes": Terries are laundered using Cheer detergent, a ten-minute wash cycle with hot (125° F) medium hardness (8–10 grain/-gallon) water, and a 2 minute rinse in warm (100° F) water. The entire wash and rinse cycles are repeated; the terries are then dried and added to the test wash load.) Drying is carred out using no fabric softening material as a control and using articles of the type described in Example VI as test articles.

Following washing and drying, the cotton terrycloths are graded "blind" by three qualified judges to determine the softness performance of the different treatments (Products). The comparisons between treatments are expressed in terms of grading scale units (GSU) where 0 GSU = No Difference
1 GSU = A Slight Difference
2 GSU = A Moderate Difference
3 GSU - A Large Difference
4 GSU - A Very Large Difference All treatment comparisons (judges' grades) are summarized and subjected to a statistical one-way analysis of variance. The treatment relationships are reported in terms of grading scale units (GSU) along with a statistical estimate of test precision. (Least Significant difference, i.e. LSD)

Static control provided by the fabric softening articles tested is measured by means of a "Faraday Cage" device which measures the amount of electrical charge imparted to a metal container by the laundry bundle. In such a test, the lower the amount of charge imparted, the more effective is the material being tested as an antistatic agent.

For softness and anti-static evaluation, two types of articles of the present invention are tested, i.e., articles such as described in Example VI wherein the softener mixture comprises about 70% by weight quaternary ammonium salt and 30% by weight sorbitan ester [the Example VI (70%/30%) articles] and the Example VI articles with a quaternary/sorbitan ester ratio of about 90%/by weight [the Example VI (90%/10%) articles].

These articles are compared with prior art articles comparable to the Example VI articles but wherein all the softener material is di(tallowalkyl) dimethylammonium methylsulfate. About 99% of the impregnate in these prior art articles is the methylsulfate quaternary material. Such articles have an average total impregnate to substrate weight ratio of about 2:1.

Results of the softness grading and anti-static Faraday Cage measurements are summarized in Table I.

TABLE I

| | Softening Grade* (Grading Scale Units) | Faraday Cage Static Measurements ($\times 10^{-7}$ coulombs) |
|---|---|---|
| No Softener (Control) | 0 | — |
| All Methyl Sulfate Articles | 1.5 | 12 |
| Example VI Articles (70%/30%) | 1.7 | 3 |
| Example VI Articles (90%/10%) | 1.6 | 3 |

*LSD = 0.4 Units

These data demonstrate that the articles of the instant invention provide fabric softening performance comparable to that of similar prior art fabric softening articles with anti-static performance superior to that provided by such prior art articles.

PAINT REMOVAL EVALUATION

The effect which articles of the present invention have on dryer drum paint in comparison with similar prior art articles is measured by means of several Paint Removal Evaluation methods.

For one such method, 5 pound loads of underwear are washed in conventional manner in Kenmore automatic washers and dried in commercially available 1973 model Kenmore gas dryers having painted dryer drums. Dryers are run for two shifts per day five days a week. For those dryers wherein fabric softening articles are tested, such articles are used with every dryer load.

Dryer paint is examined after 400 hours and 900 hours of running time and paint removal from the drum is visually graded as a 0 to 5 scale in order of increasing severity of removal. A significant difference on this scale is 0.5 grading units. 900 hours of running time on this test is roughly equivalent to 5 years of home dryer use.

Using this method, paint removal by two types of articles of the instant invention (Example VI 90%/10% and Example VI 70%/30% as described hereinbefore) are compared with paint removal occurring with A) no fabric softener; B) a commercially available rinse added fabric softener; and C) and D) two types of articles similar to the Example VI articles, one of which utilizes only a di(tallowalkyl) dimethylammonium methylsulfate softener and the other of which utilizes only a di(tallowalkyl) dimethylammonium chloride softener.

The methylsulfate articles are the same as described above for the fabric softening and anti-static evaluation. The articles utilizing the chloride softener employ an impregnate containing about 85% by weight of the quaternary ammonium chloride and an average total impregnate to substrate ratio of about 2.4:1. These "chloride" articles contain an average of about 2.8 grams of the quaternary material per sheet.

Paint removal results are summarized in Table II.

TABLE II

| Fabric Softening Means | Paint Removal Grade at 400 hours (Grading Units) | Paint Removal Grade at 900 hours (Grading Units) |
|---|---|---|
| No softener | 0.1 | 0.2 |
| Rinse-Added Softener | 0.2 | 0.4 |
| Example VI Articles (70%/30%) | 0.2 | 0.2 |
| Example VI Articles (90%/10%) | 0.2 | 0.6 |
| Example VI Type Articles - Methyl Sulfate Softener | 0.5 | 1.1 |
| Example VI Type Articles - Chloride Softener | 5.0 | — |

In a second similar method, various fabric softening articles of the type described above are tested when used with a particularly abrasive fabric load (17 pounds) in the same type of Kenmore automatic dryers described above. The general procedure and paint removal grading system are the same as outlined above. Due to the abrasive nature of the dryer load, 400 hours of dryer running is roughly equivalent in this test to 7 years of home dryer use.

Results of such paint removal testing are provided in TABLE III.

TABLE III

| Fabric Softening Means | Paint Removal Grade at 400 hours (Grading Units) |
|---|---|
| No Softener | 0.4 |
| Example VI - Articles (70%/30%) | 1.4 |
| Example VI - Type Articles Methyl Sulfate Softener | 1.9 |
| Example VI - Type Articles Chloride Softener | 4.0 |

The above paint softening data demonstate that the dryer fabric softening articles of the present invention provide dryer paint softening results which are not significantly different from those obtained with a conventional through-the-rinse fabric softener. Furthermore, the particular articles of the instant invention are significantly less harmful to dryer drum paint than those dryer fabric conditioning articles of the prior art which contain only quaternary ammonium chloride fabric softening agents.

DRYER CORROSION TESTING

The propensity of the various fabric softening articles described above to contribute to corrosion of automatic clothes dryers is evaluated by means of dryer corrosion testing. In one such test method, pre-weighed plates (1½ inch × 4 inches) of coldrolled carbon steel (Type 1018) are fastened in the drums of Kenmore electric dryers. Mixed fabric loads weighing 5½ pounds are washed in conventional manner in water of 8 grains/gallon hardness and dried in the test dryers for 45 minutes along with the articles being tested. After 16 washing and drying cycles, the plates are removed and stored in an environment at 80° F and 80% relative humidity for seven days.

After that time the test plates are visually graded for rusting on a scale of 0 to 16 (Higher grades mean more rusting). The plates are also weighed inasmuch as weight gain (i.e., pickup of oxygen and water) can be taken as a measure of increased rusting. For small amounts of rusting (i.e., at visual grades equal to or less than 4), visual testing results are very reproducible. For higher rusting levels, the weight gain rusting measurements tend to be more meaningful. Both visual and weight gain comparative rusting measurements are provided in TABLE IV for articles such as those used in the paint softening evaluation described above.

TABLE IV

| Softening Means Employed | Rusting Grades Visual (Grading Units) | Rusting Grades Weight Gain (Mg.) |
|---|---|---|
| Example VI Articles (70%/30%) | 3 | 1 |
| Example VI Articles (90%/10%) | 3 | 2 |
| Example VI Type Articles Methyl Sulfate Softener | 8 | 10 |
| Example VI Type Articles Chloride Softener | 14 | 34 |

TABLE IV-continued

| Softening Means Employed | Rusting Grades Visual (Grading Units) | Weight Gain (Mg.) |
|---|---|---|
| Rinse-Added Softener | 3 | 1 |

In another dryer corrosion testing method, these same fabric softening articles are tested in automatic dryers having bare metal drums. Such unpainted dryer drums or sections thereof have been subjected to all pretreating and cleaning processes normally employed in the manufacture of commercially available automatic dryers.

Dryers utilized are located in a laboratory with climatological conditions ranging from 80° F to 90° F and 80% to 95% relative humidity. Mixed fabric loads weighing 7 pounds are washed and dried in the same manner as described above. Dryers containing the test articles are operated on the basis of 16 cycles per day, five days per week. Rusting levels in each dryer are graded visually, again on a 0 to 16 scale. Results are provided in TABLE V.

TABLE V

| Fabric Softening Means | Rusting Grade at 25 Hours of Dryer Running Time (Grading Units) | Rusting Grade at 75 Hours of Dryer Running Time (Grading Units) |
|---|---|---|
| Rinse Added Softener | 3 | 8 |
| Example VI Articles (70%/30%) | 2 | 5 |
| Example VI Articles (90%/10%) | 4 | 11 |
| Example VI Type Articles - Methyl Sulfate Softener | 8 | 16 |
| Example VI Type Articles - Chloride Softener | 16 | — |

The above corrosion data demonstrate that the fabric softening articles of the present invention tend to promote corrosion of dryer drum metal to a much lesser extent than similar prior art articles employing chloride or methyl-sulfate softening agents alone.

What is claimed is:

1. An article of manufacture adapted for providing fabric softening within an automatic laundry dryer, said article comprising:

a. a fabric softening amount of a softening composition having a melting point above about 38° C and being flowable at dryer operating temperatures, said composition comprising:

i. from about 50% to 92% by weight of the composition of a cationic fabric softener material; and ii. from about 8 up to 50% by weight of the composition of a fatty alkyl sorbitan ester component selected from the group consisting of $C_{10}$ to $C_{26}$ fatty esters of sorbitan and ethoxylates of said esters wherein one or more of the unesterified —OH groups in said esters contain from 1 to about 20 oxyethylene moieties; the weight ratio of cationic fabric softener material to sorbitan ester component being greater than 1:1; and b. a dispensing means which provides for release of said softening composition within an automatic laundry dryer at dryer operating temperatures, wherein when said dispensing means is a flexible substrate in sheet configuration the fabric softener is releasably affixed to said substrate to provide a weight ratio of softening composition to dry substrate ranging from about 10:1 to 0.5:1.

2. An article according to claim 1 wherein the cationic softener material is a quaternary ammonium fabric softener and is present in the softener composition in an amount of from about 65% to about 92% and wherein the sorbitan ester is present in an amount of from about 8% to about 35%.

3. An article according to claim 2 wherein the quaternary ammonoim softener is in the methylsulfate form.

4. An article according to claim 3 wherein the quaternary ammonium softener is selected from the group consisting of ditallowalkyldimethylammonium methylsulfate, distearydimethylammonium methylsulfate, dipalmityldimethylammonium methylsulfate and dibehenyldimethylammonium methylsulfate.

5. An article according to claim 4 wherein the sorbitan ester component is selected from the group consisting of the $C_{10}$ – $C_{26}$ alkyl sorbitan esters, and mixtures thereof.

6. An article according to claim 5 wherein the sorbitan ester component comprises a member selected from the group consisting of $C_{10}$ – $C_{26}$ alkyl sorbitan mono-esters and $C_{10}$—$C_{26}$ alkyl sorbitan di-esters, and mixtures thereof.

7. An article according to claim 6 wherein the sorbitan ester component comprises a member selected from the group consisting of sorbitan monolaurate, sorbitan monomyristate, sorbitan monopalmitate, sorbitan monostearate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed coconutalkyl sorbitan mono- and di-esters and mixed tallowalkyl sorbitan mono- and di- esters.

8. An article according to claim 6 wherein the dispensing means comprises a flexible substrate in sheet configuration and wherein the softening composition is impregnated in the substrate to provide a weight ratio of softening composition to dry substrate ranging from about 10:1 to about 0.5:1.

9. An article according to claim 8 wherein the substrate has an absorbent capacity of from about 4 to about 12.

10. An article according to claim 9 wherein the substrate comprises a non-woven cloth having an absorbent capacity of from about 5 to 7, wherein the weight ratio of softening composition to substrate on a dry weight basis ranges from about 5:1 to 1:1 and wherein the methylsulfate material comprises from about 65% to 92% by weight and the sorbitan ester material comprises from about 8% to 35% by weight of the softening composition.

11. An article according to claim 10 wherein the non-woven cloth substrate comprises cellulosic fibers, said fibers having a length of from 3/16 inch to 2 inches and a denier of from 1.5 to 5 and wherein said substrate is adhesively bonded together with a binder resin.

12. An article according to claim 11 wherein the softening composition comprises from about 65% to 75% by weight of the composition of ditallowalkyldimethylammonium methyl sulfate and from about 25% to 35% by weight of the composition of a sorbitan ester component selected from the group consisting of sobitan monolaurate, sorbitan monomyristate, sorbitan monopalmitate, sorbitan monostearate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed coconutalkyl sorbitan mono- and di-esters and mixed tallowalkyl sorbitan mono- and di-esters.

13. An article according to claim 12 wherein the flexible substrate has openings sufficient in size and number to reduce restriction by said article of the flow of air through an automatic dryer.

14. An article according to claim 13 wherein said openings comprise from about 0.5% to about 75% of the area of the article.

15. An article according to claim 1 wherein the dispensing means comprises a flexible substrate in a sheet configuration having the softening composition releasably affixed thereto.

16. An article according to claim 1 wherein the dispensing means is an aerosol spray device.

17. A method for imparting a softening and antistatic effect to fabrics in an automatic laundry dryer comprising commingling pieces of damp fabrics by tumbling said fabrics under heat in an automatic clothes dryer with an effective amount of a fabric softening composition, said composition having a melting point greater than about 38° C and being flowable at dryer operating temperatures, said composition comprising:

a. from about 50% to 99.9% by weight of the composition of a cationic fabric softener material; and b. from about 0.1% up to 50% by weight of the composition of a fatty alkyl sorbitan ester component selected from the group consisting of $C_{10}$ to $C_{26}$ fatty esters of sorbitan and ethoxylates of said esters wherein one or more of the unesterified -OH groups in said esters contain from 1 to about 20 oxyethylene moieties;

the weight ratio of cationic fabric softener material to sorbitan ester component being greater than 1:1.

18. A method according to claim 17 wherein the cationic fabric softener material is a quaternary ammonium material comprising from about 65% to 92% by weight of the softening composition and wherein the sorbitan ester component comprises from about 8% to 35% by weight of the softening composition.

19. A method according to claim 17 wherein the softening composition is applied to the drum of the automatic clothes dryer.

20. A method according to claim 17 wherein the softening composition is applied to the fabrics from a flexible substrate having an absorbent capacity of from about 4 to 12.

21. A method according to claim 20 wherein the cationic fabric softener material is a quaternary ammonium compound and wherein the sorbitan ester component of the softening composition is selected from the group consisting of sorbitan monolaurate, sorbitan monomyristate, sorbitan monopalmitate, sorbitan monostearate, sorbitan monobehenate, sorbitan monooleate, sorbitan dilaurate, sorbitan dimyristate, sorbitan diplamitate, sorbitan distearate, sorbitan dibehenate, sorbitan dioleate, and mixtures thereof, and mixed coconutalkyl sorbitan mono- and di-esters and mixed tallowalkyl sorbitan mono- and di-esters.

22. A method according to claim 21 wherein the cationic fabric softener material is ditallowalkyldimethylammoniummethylsulfate and the sorbitan ester component comprises a mixture of sorbitan monostearate and sorbitan monopalmitate.

* * * * *

UNITED STATES PATENT OFFICE

CERTIFICATE OF CORRECTION

PATENT NO. : 4,022,938

DATED : May 10, 1977

INVENTOR(S) : W. N. Zaki and A. P. Murphy

It is certified that error appears in the above-identified patent and that said Letters Patent are hereby corrected as shown below:

Col. 1, line 28, "along" should be -- alone --.

Col. 4, line 56, "and", second occurrence, should be -- are --.

Col. 14, line 12, "inches" should be -- inch --.

Col. 24, line 7, "carred" should be -- carried --.

Col. 25, line 54, "17" should be -- 7 --.

Col. 27, line 38, "methyl-sulfate" should be -- methyl sulfate --.

Col. 28, line 16, "distearydimethylammonium" should be -- distearyldimethylammonium --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*